US008545161B2

(12) United States Patent
Wanek-Pusset et al.

(10) Patent No.: US 8,545,161 B2
(45) Date of Patent: Oct. 1, 2013

(54) UNLOADING VEHICLE AND COMBINATION OF AN UNLOADING VEHICLE WITH A CONTAINER

(76) Inventors: Peter Wanek-Pusset, Kapfenberg (AT); Bernhard Grentner, Breitenau (AT)

( * ) Notice: Subject to any disclaimer, the term of this patent is extended or adjusted under 35 U.S.C. 154(b) by 108 days.

(21) Appl. No.: 12/474,817

(22) Filed: May 29, 2009

(65) Prior Publication Data

US 2010/0303598 A1 Dec. 2, 2010

(51) Int. Cl.
*B66F 9/16* (2006.01)

(52) U.S. Cl.
USPC ..... 414/629; 414/632; 414/641; 187/237

(58) Field of Classification Search
USPC ..... 414/629, 411, 641, 642; 187/237, 187/238
See application file for complete search history.

(56) References Cited

U.S. PATENT DOCUMENTS 2,706,623 A * 4/1955 Styes ..... 366/26
4,378,188 A * 3/1983 Hardwick ..... 414/411
5,215,427 A * 6/1993 Olsthoorn et al. ..... 414/664
5,362,198 A * 11/1994 Patrick ..... 414/810
5,730,576 A * 3/1998 O'Daniel ..... 414/421
7,360,628 B2 * 4/2008 Charvet ..... 187/237

FOREIGN PATENT DOCUMENTS

DE 10127949 A1 * 12/2002
JP 02136799 A * 5/1990

OTHER PUBLICATIONS

DE 10127949 A1 (Tropp, Axel) Dec. 19, 2002 (English language machine translation). [online] [retrieved May 28, 2013]. Retrieved from: Espacenet.*

* cited by examiner

*Primary Examiner* — Jonathan Snelting
(74) *Attorney, Agent, or Firm* — Ostrolenk Faber LLP

(57) ABSTRACT

An unloading vehicle for the rotary unloading of a container, able to be covered by a fixed cover, which has a container base with two fork pockets, with a frame on which a carrier, provided with a pair of fork prongs, is mounted so as to be rotatable about an axis running horizontally and parallel to the fork prongs. In order to be able to handle not only the container but also its cover by an unloading vehicle, a further carrier is provided above the rotatably arranged carrier, which is provided with a receiving arrangement for taking hold of the cover of the container, and is vertically adjustable and/or able to be swiveled up and down with respect to the framed.

11 Claims, 7 Drawing Sheets

UNLOADING VEHICLE AND COMBINATION OF AN UNLOADING VEHICLE WITH A CONTAINER

Figure 1:
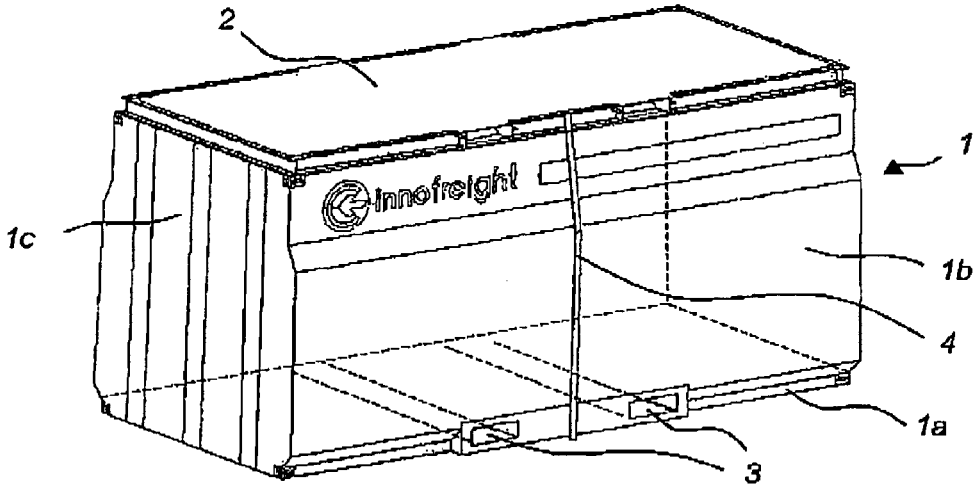

The invention relates to an unloading vehicle for the rotary unloading of a container which is able to be covered by a fixed cover, which has a container base with two fork pockets, with a frame on which a carrier, provided with a pair of fork prongs, is rotatably mounted about an axis running horizontally and parallel to the fork prongs. The invention further relates to a combination of an unloading vehicle with a container cover.

From EP-A-1 690 809 a container is known for the transporting of bulk goods in railway freight transportation or on lorries. The container can be unloaded by rotating or tipping. Moisture-sensitive bulk goods or bulk goods which could be blown off during the journey must be covered during transportation; usually tarpaulin systems are used for this. A disadvantage in this solution is the considerable effort in handling.

The invention is based on the problem of simplifying the handling for emptying a container filled with bulk goods, which is provided with a cover for transportation.

The problem which is posed is solved according to the invention in that above the rotatably arranged carrier, a further carrier is provided which is provided with a receiving arrangement to take hold of the cover of the container and is vertically adjustable and/or swivellable up and down with respect to the frame.

The invention therefore allows not only the container to be handled with an unloading vehicle, but also its cover, so that it is no longer necessary to remove the latter in advance. A device designed according to the invention therefore distinctly shortens the expenditure of time for the handling of the container for emptying and therefore also simplifies the procedure for emptying the container.

The unloading vehicle is to have an expedient and, at the same time, stable construction, which allows the desired handling of the container and its cover. It is therefore advantageous if the frame has an upper and a lower frame part, wherein the upper frame part carries the carrier which is provided with the receiving arrangement.

In order to carry out the movement sequences necessary for taking hold of and lifting the cover in an expedient manner, the upper frame part is vertically displaceable or adjustable with respect to the lower frame part.

In a preferred embodiment of the invention, the receiving arrangement for taking hold of the cover of the container is a further pair of fork prongs. In an alternative variant embodiment, the receiving arrangement can be provided with electromagnets, in particular on its underside.

An unloading vehicle constructed according to the invention allows either a removal of the cover of the container by lifting, by the upper frame part with the receiving arrangement and the cover taken hold of thereby being moved up, or by a swivelling up of a further carrier which for this purpose is arranged so as to be swivelled up and down on the upper frame part.

The invention further relates to combinations of unloading vehicles with container covers. In a particularly preferred such combination, a container cover is provided which is provided with a pair of fork mountings. The further pair of fork prongs can be moved into these fork mountings for the handling of the container cover. In a further combination according to the invention, the container cover is provided with at least one metallic part which is able to be engaged by the electromagnets.

Further features, advantages and details of the invention are now described in further detail by means of the drawings, illustrating example embodiments diagrammatically, in which are shown.

Figure 1A:
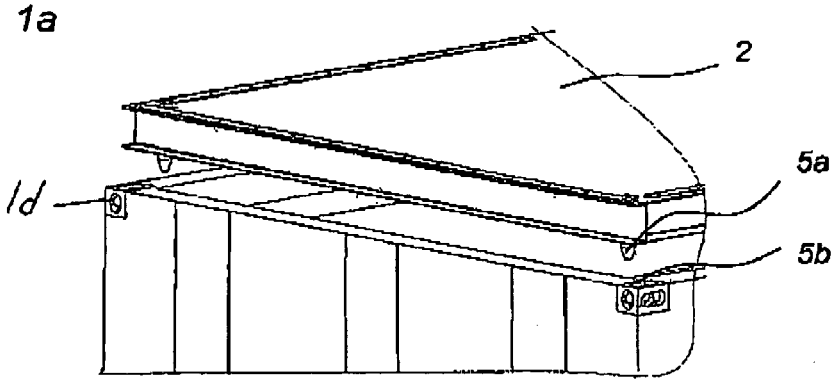
Figure 2:
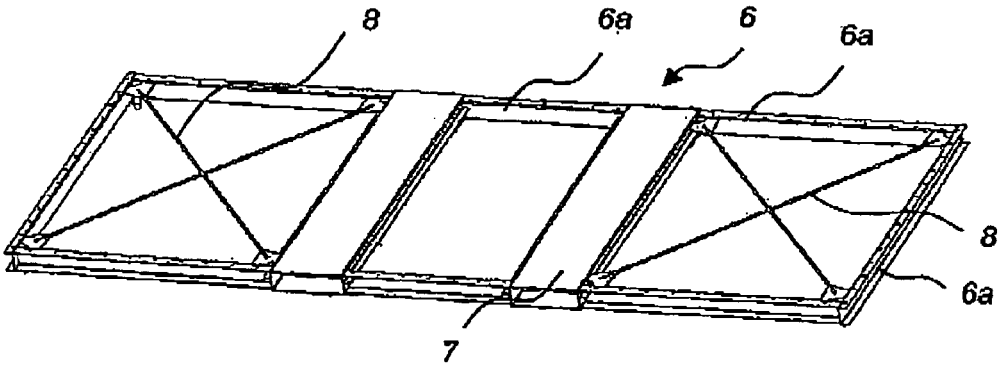
Figure 3:
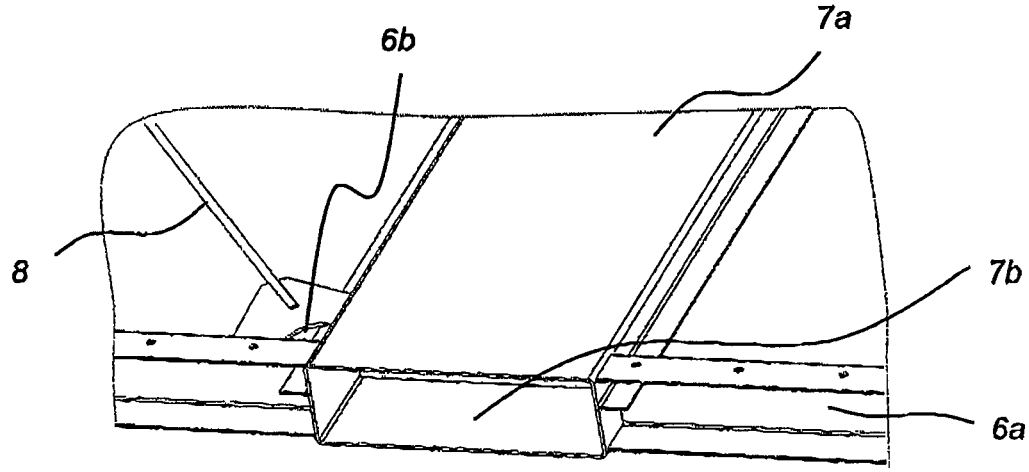
Figure 4:
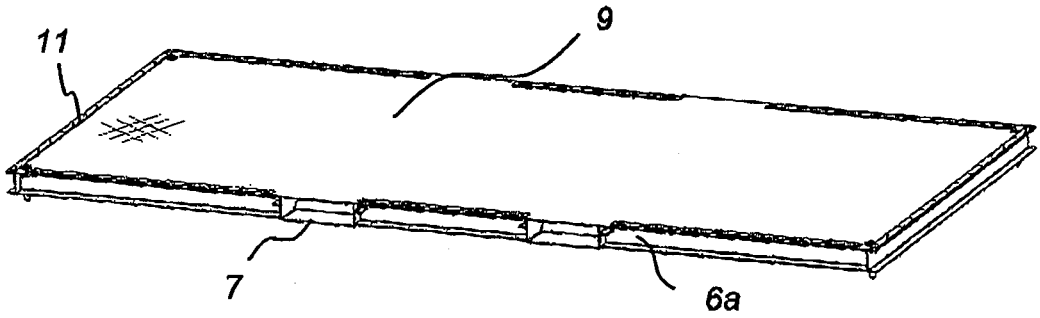
Figure 5:
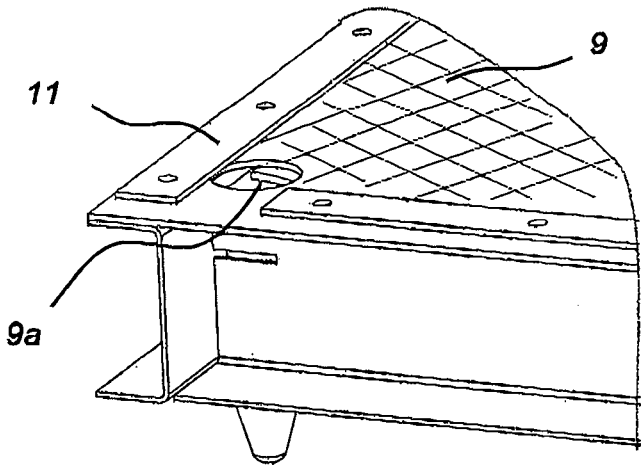
Figure 6:
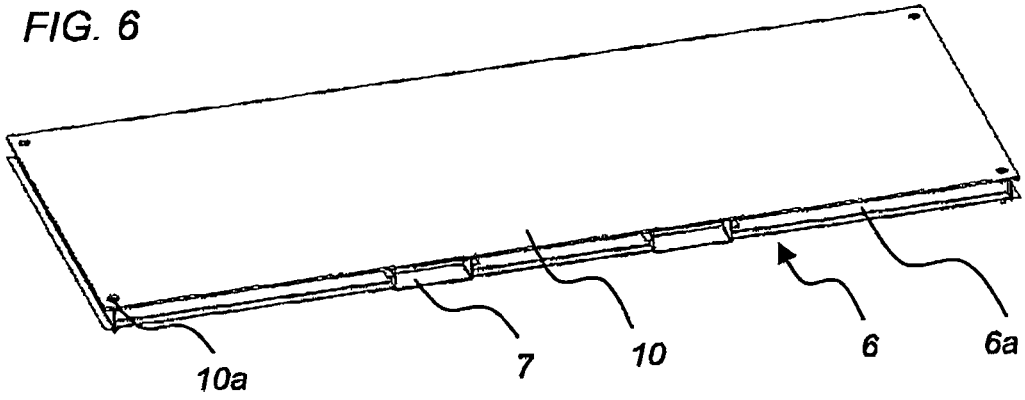

FIG. 1 an oblique view of a container with cover and lashing strap,

FIG. 1*a* a detail of FIG. 1,

FIG. 2 an embodiment of a framework construction of the cover,

FIG. 3 a detail of FIG. 2 in enlarged illustration,

FIG. 4 a view of a cover with a net covering,

FIG. 5 a detail of FIG. 4 in enlarged illustration,

FIG. 6 a view of a cover with a fixed covering,

FIG. 7*a* to 7*e*, FIG. 8*a* to 8*c* and FIG. 9*a* to 9*e* different embodiment variants of unloading vehicles, in particular during their operation.

The container 1 illustrated by way of example in FIG. 1 is in particular a container constructed according to the standards in force in railway freight transportation, which is used for the conveying of bulk goods, chips and biomass, if applicable also on lorries. The container 1 has a rectangular base 1*a*, two side walls 1*b* and two walls 1*c* on the end side. The container 1 is upwardly open and is able to be closed by means of a separate cover 2. On the inner side of the base 1*a*, two fork pockets 3 are arranged transversely to the longitudinal extent of the container 1 and symmetrically to the central transverse axis of the container base 1*a*. The fork pockets 3, which are formed from corresponding steel profiles, have rectangular cavities in cross-section, which extend continuously from side wall 1*b* to side wall 1*b* and are respectively open here. The spacing and the cross-sectional dimensions of the fork pockets 3 are adapted to two fork prongs of an unloading vehicle, which is described further.

The cover 2, which is merely resting in the embodiment which is shown, is secured by a lashing strap 4, mounted for example on reinforcement plates. As FIG. 1*a* shows, the cover 2 is secured on each container corner against slipping by pins 5*a* which engage in depressions 5*b* on corner fittings 1*d*.

FIG. 2 and FIG. 3 show the stable, self-supporting basic frame of the cover 2 of a rectangular framework 6 of U-shaped steel profiles 6*a* welded together. The framework 6, adapted to the rectangular shape of the upper opening of the container 1 has two long sides which are connected with each other by two short transverse sides. The framework construction is reinforced by struts 8 running diagonally. Parallel to the transverse sides and symmetrically to the central transverse axis of the framework 6, two fork receiving locations 7 are formed from hollow steel profiles 7*a*, 7*b* (FIG. 3) and are welded to the U-profiles 6*a* on the longitudinal sides of the framework 6. The fork receiving locations 7 have rectangular openings on the longitudinal sides of the framework 6, their dimensions and their reciprocal spacing are adapted to the reciprocal spacing and the dimensions of fork prongs of an unloading vehicle, as will be described further.

On the frame 6, a rectangular cover element is fastened, which according to FIG. 4 and FIG. 5 is a metallic net 9 or, according to FIG. 6, a solid metallic plate 10. The net 9 can be screwed to the framework 6 by means of straps 11, as shown in FIG. 5. Openings 6*b*, aligned with each other, on the frame 6 (FIG. 3) and on the cover element 9, 10 (see openings 9*a*, 10*a*) allow a stacking of several covers 2, by the pins 5*a* of covers 2, stacked on each other, engaging into the openings 6*b* and 9*a* or 10*a* of the respectively other cover 2.

Figure 7A:
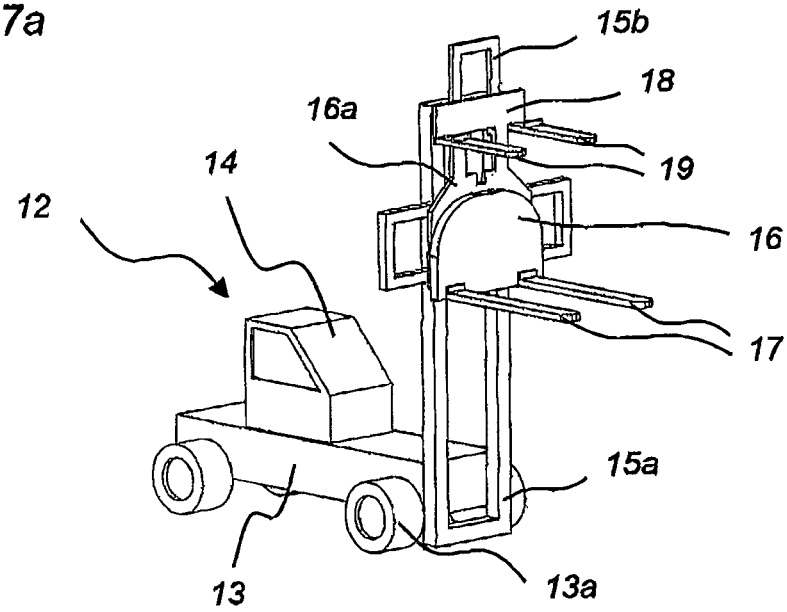

FIG. 7*a* shows a variant embodiment of an unloading vehicle 12 with a chassis 13 with four wheels 13*a* and a driver's cab 14 and with a lifting frame 15 arranged on the chassis 13. The lifting frame 15, standing vertically, has a lower frame part 15*a* and an upper frame part 15*b* which is displaceable with respect thereto in vertical direction. On the lower frame part 15*a* a carrier 16, which has two parallel fork prongs 17 running horizontally, is arranged displaceably in vertical direction. The lower carrier 16 is mounted here on a rotary arrangement 16*a* and is rotatable in such a way relative to the lifting frame about an axis running parallel to the fork prongs 17. On the upper frame part 15*b* a further carrier 18 is fastened, which is likewise provided with two fork prongs 19 running horizontally and parallel to each other. The upper frame part 15*b* can be connected with the rotary arrangement, in order to couple vertical movements. In addition, provision can be made to arrange the lifting frame 15 so as to be displaceable with respect to the chassis 13 in lateral direction. The fork prongs 17 on the lower carrier 16 are constructed to be longer than the fork prongs 19 on the upper carrier 18.

Figure 7B:
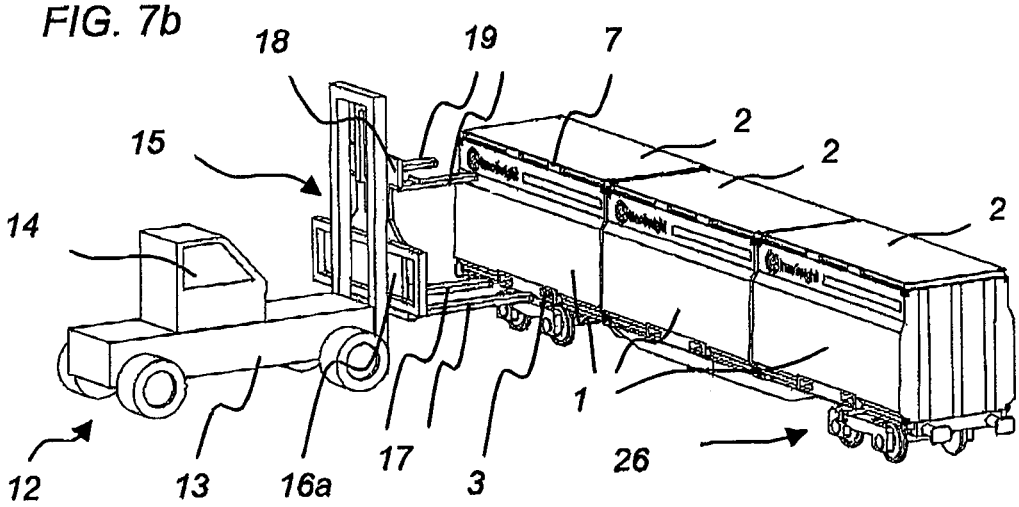
Figure 7C:
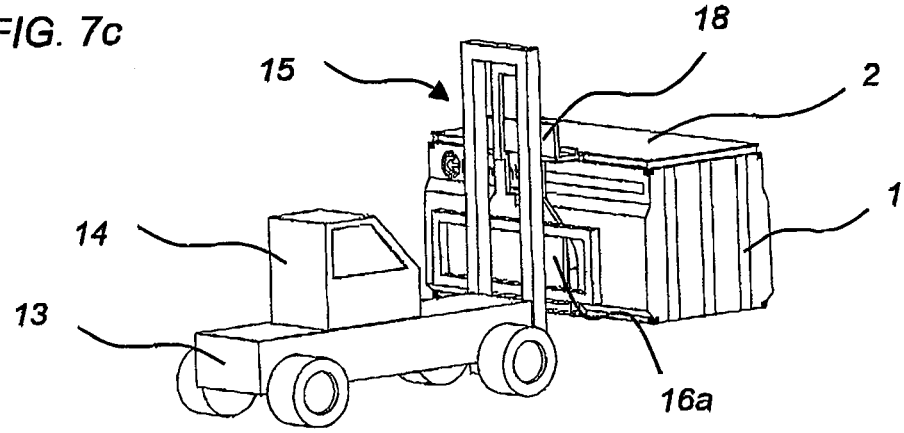
Figure 7D:
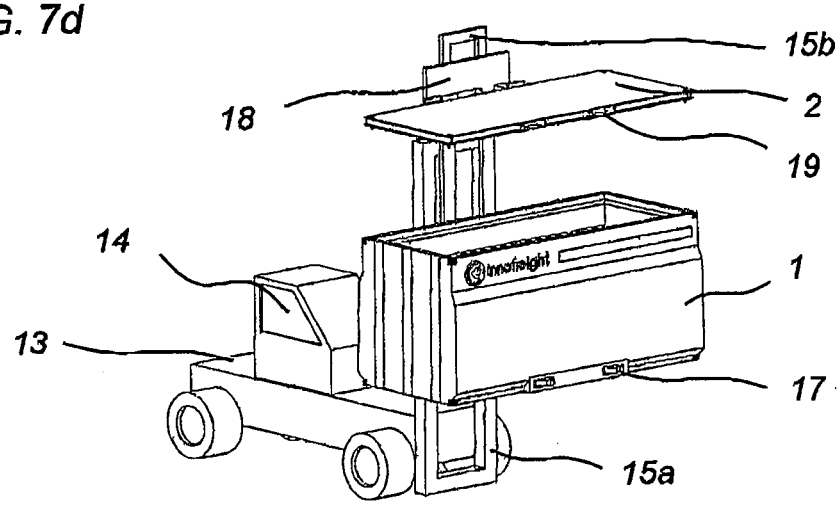
Figure 7E:
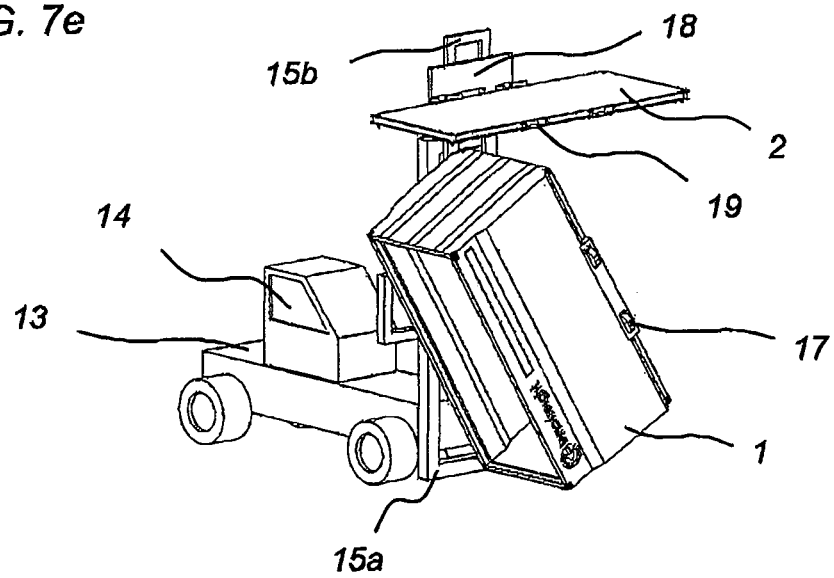

FIG. 7*b* to 7*e* show stages in the handling and emptying of a container 1 with the loading vehicle 12. FIG. 7*b* shows a container carrier wagon 26 with three containers 1 laden with bulk goods. The lashing straps have already been removed. The loading vehicle 12 is moved up to one of the containers 1, the fork prongs 19 are brought into position opposite the fork receiving locations 7 of the cover 2, the fork prongs 17 opposite the fork pockets 3 on the base 1*a* of the container 1. Firstly, the lower, longer fork prongs 17 move in, then the fork prongs 19. The container 1 which is received by the loading vehicle and is still provided with the cover 2 (FIG. 7*c*) is moved to the unloading point. At the start of the unloading process, the upper frame part 15*b* is raised, so that the cover 2 is lifted from the container 1. In the upper final position of the upper frame part 15*b*, the distance between the container 1 and the cover 2 is large enough to introduce the rotary movement. FIG. 7*e* shows the container 1, rotated for emptying, with the cover 2 raised. The empty container 1 is turned back into its starting position again and the cover 2 is positioned by lowering the upper frame part 15*b* on the container 1. The unloading vehicle 12 can then transfer the container 1 to the container carrier wagon.

Figure 8A:
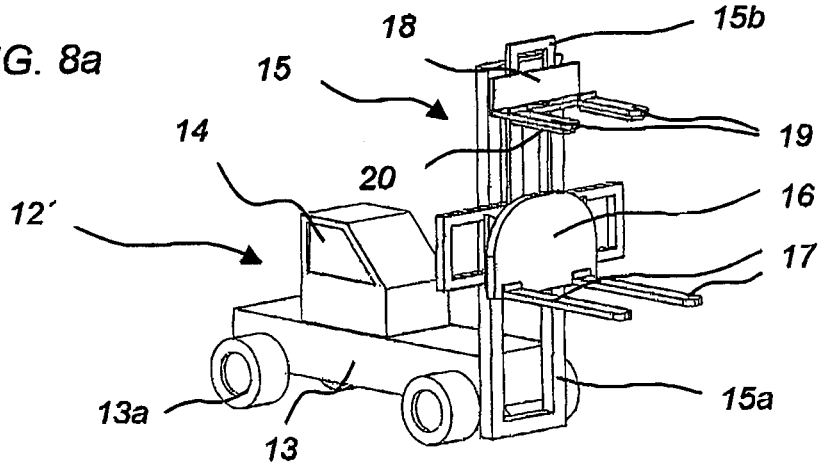
Figure 8B:
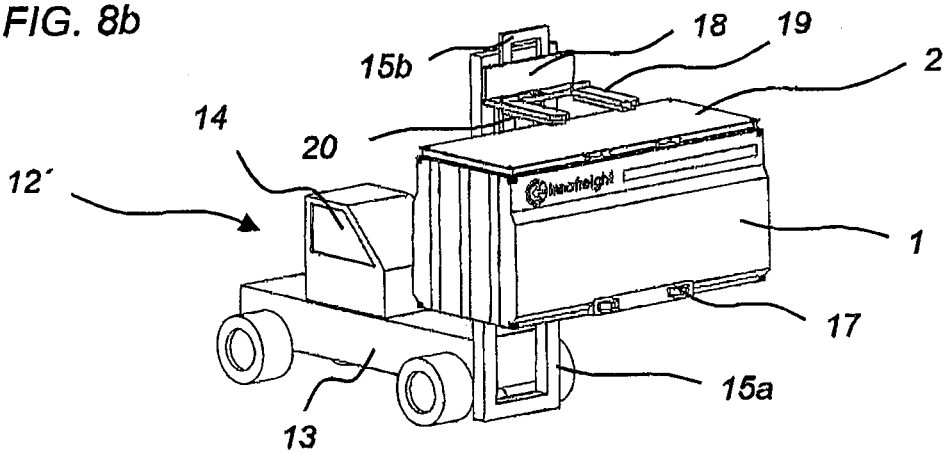
Figure 8C:
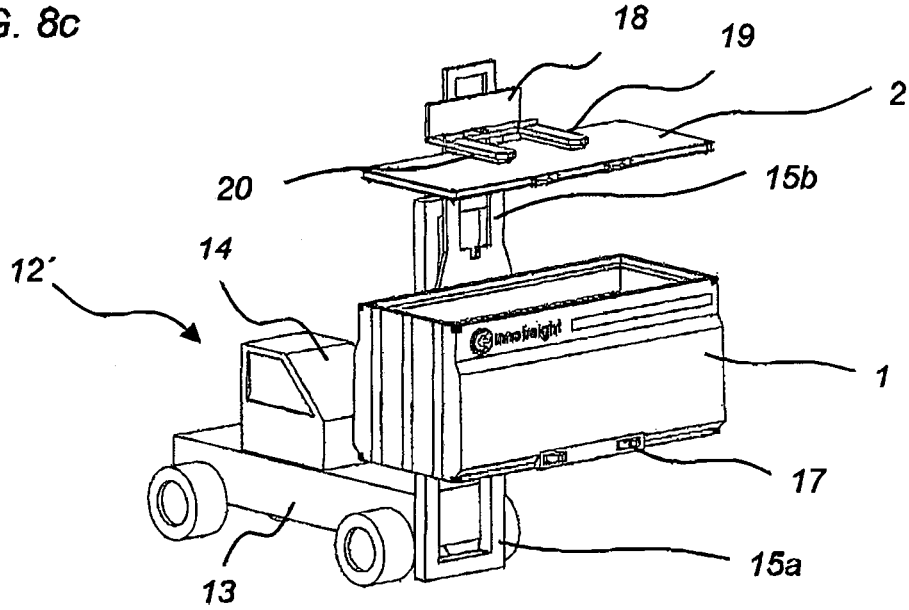

An alternative embodiment of an unloading vehicle 12' and the container handling therewith is shown by FIG. 8*a* to FIG. 8*c*. The loading vehicle 12' has a chassis 13, wheels 13*a*, a cab 14, a lifting frame 15 with an upper frame part 15*b* and a lower frame part 15*a*. On the lower frame part 15*a* a carrier 16 with fork prongs 17, rotatably mounted by means of a rotary arrangement 16*a*, is arranged, on the upper frame part 15*b*, which is vertically displaceable with respect to the lower frame part 15*a* in vertical direction, a carrier 18 with fork prongs 19 is arranged. On the undersides of the fork prongs 19, electromagnets 20 are arranged. Here, instead of the two prongs 19, a plate, in a single piece, can be provided with electromagnets 20 on its underside. The container 1, filled with bulk goods, is lifted by means of the lower, longer fork prongs 17 from the transport arrangement, for example a container carrier wagon, wherein firstly the upper frame part 15*b* is positioned at a distance from the container 1 (FIG. 8*b*). Now, the carrier 18 is lowered, so that the cover 2 is taken hold of on its upper side by the electromagnet 20 and by a raising of the upper frame part 15*b* is removed from the container 1 (FIG. 8*c*). The unloading of the container 1 by rotation takes place in an analogous manner to that described above, likewise the subsequent return transfer of the container 1 to the container carrier wagon.

Figure 9A:
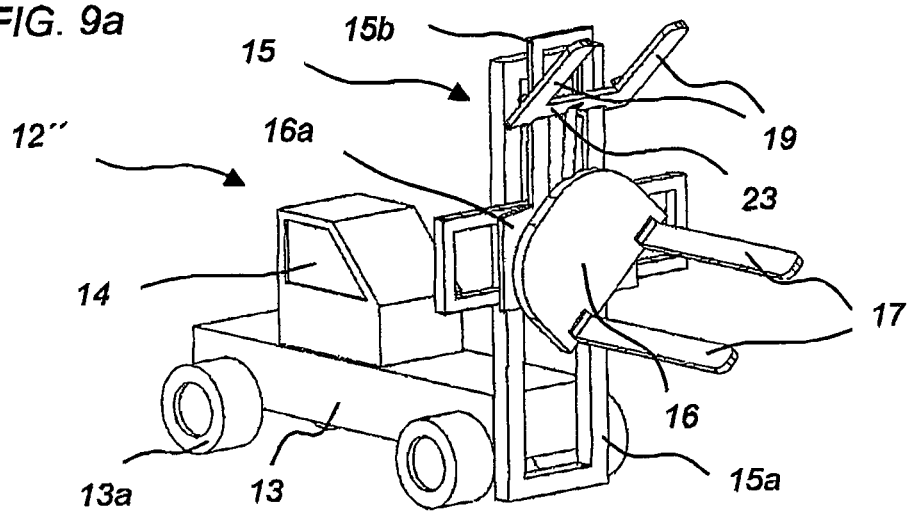
Figure 9B:
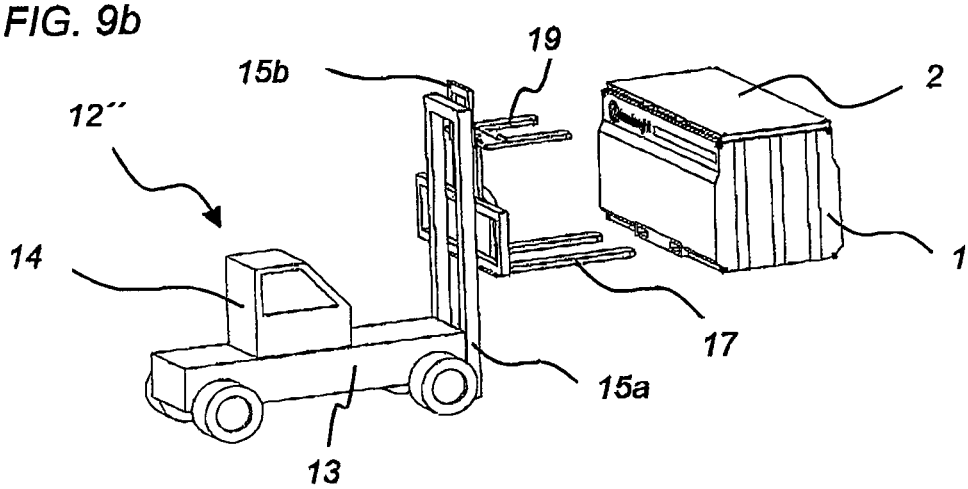
Figure 9C:
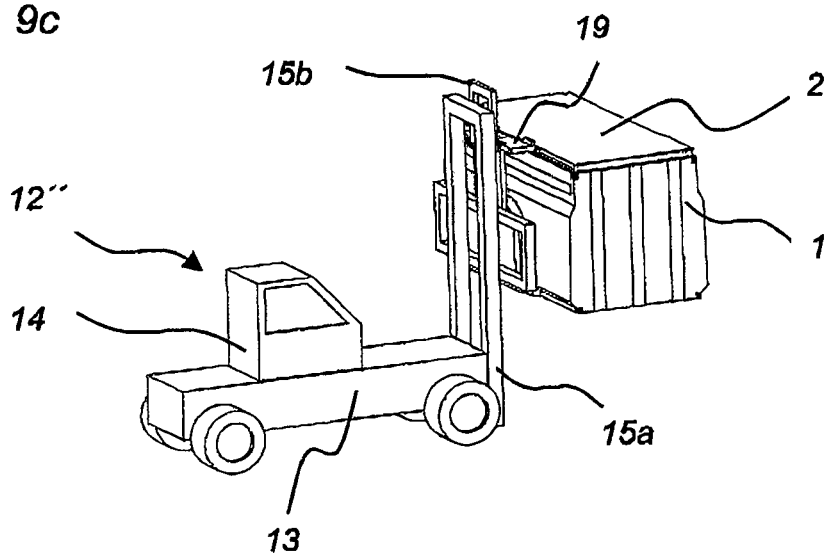
Figure 9D:
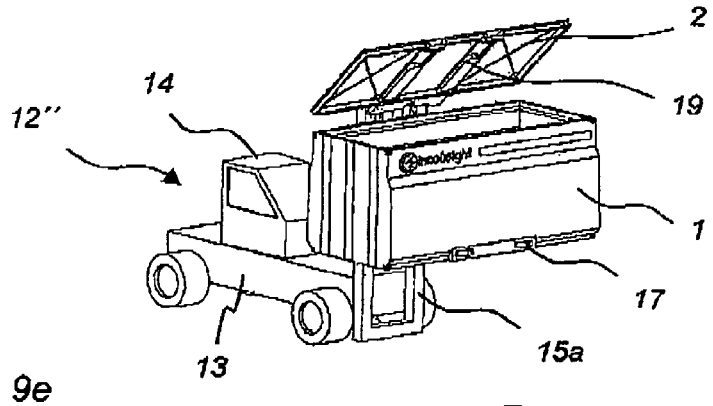
Figure 9E:
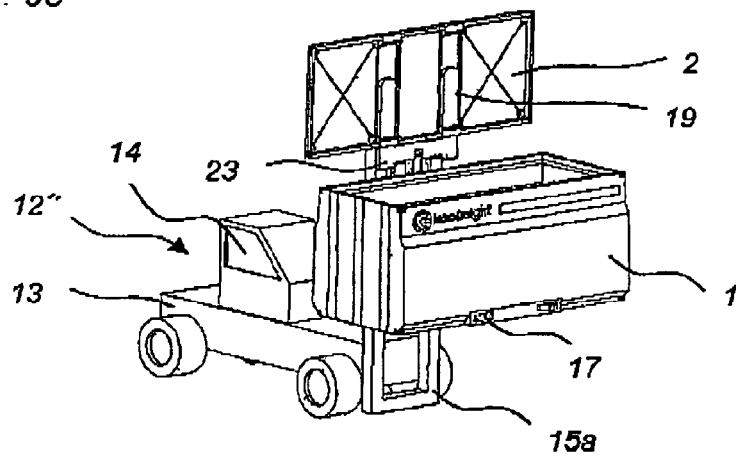
Figure 9F:
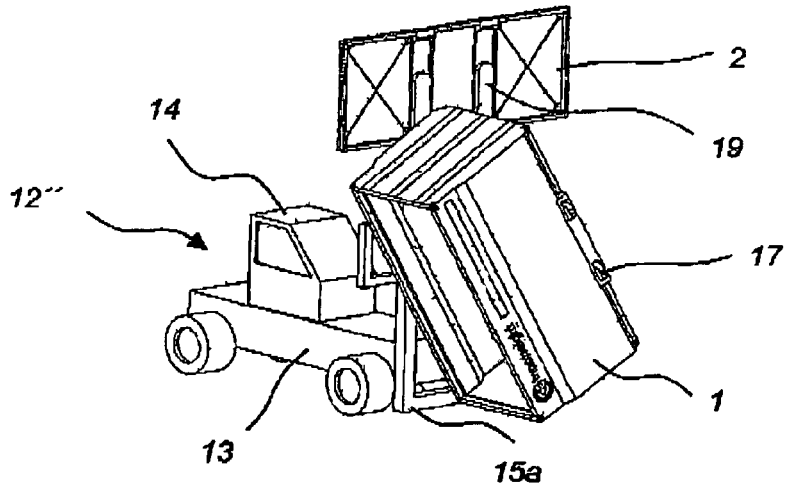

FIGS. 9*a* to 9*f* show a further embodiment of an unloading vehicle 12" and stages of the handling of a container 1. The unloading vehicle 12" has a chassis 13, wheels 13*a*, a drivers cab 14 and a lifting frame 15. The lifting frame 15, standing vertically, has a lower frame part 15*a* and an upper frame part 15*b*, displaceable or adjustable in vertical direction with respect thereto. On the lower frame part 15*a*, a carrier 16, which has two parallel fork prongs 17 running horizontally, is arranged so as to be displaceable in vertical direction. The carrier 16 is mounted here on a rotary arrangement 16*a* and is rotatable in such a way relative to the lifting frame about an axis running parallel to the fork prongs 17. On the frame part 15*b* a carrier 23, having fork prongs 19, is rotatably arranged about an axis running horizontally and transversely to the fork prongs 19. The reciprocal distance between the carriers 16, 23 or their fork prongs 17, 19 is adapted or able to be adapted to the distance of the fork pockets 3 of the container 1 to the fork mountings 7 in the cover 2 which is positioned thereon. The longer fork prongs 17 on the carrier 23 move firstly into the fork pockets 3 on the container 1, then the fork prongs 19 into the cover 2. The container 1 received by the unloading vehicle 12" (FIG. 9*c*) is moved to the unloading position. The cover 2 is opened by a rotary movement of the carrier 23, as shown in FIG. 9*d*. When the cover 2 is fully opened, the latter is aligned perpendicularly (FIG. 9*e*), so that now the container 1 can be turned about the rotation arrangement 16*a*, until the bulk goods situated in it are emptied out of the container (FIG. 9*f*). The container 1 is then turned back into its starting position, the cover 2 is positioned again and the empty container 1 is brought back to the container carrier wagon.

The unloading vehicles 12, 12' and 12" constructed according to the invention can be additionally used to close containers 1, filled with bulk goods and positioned on the transport vehicle, with covers 2.

LIST OF REFERENCE NUMBERS

1 . . . container
1*a* . . . base
1*b* . . . side wall
1*c* . . . end-side wall
1*d* . . . corner fitting
2 . . . cover
3 . . . fork pockets
4 . . . lashing strap
5*a* . . . bolt, pin
5*b* . . . depression
6 . . . framework
6*b* . . . openings
7 . . . fork receiving locations
7*a* . . . steel profile
7*b* . . . steel profile
8 . . . struts
9 . . . metallic net
9*a* . . . opening
10 . . . solid plate
10*a* . . . opening
11 . . . strips
12 . . . unloading vehicle
12' . . . unloading vehicle
12" . . . unloading vehicle
13 . . . chassis
13*a* . . . wheels
14 . . . cab
15 . . . lifting frame
15*a* . . . frame part
15*b* . . . frame part
16 . . . carrier
16*a* . . . rotary arrangement
17 . . . fork prongs
18 . . . carrier
19 . . . fork prongs

20 . . . electromagnet
23 . . . carrier
26 . . . wagon

The invention claimed is:

1. Unloading vehicle for the rotary unloading of a container, the container being configured to be covered by a cover, the container having a container base with two fork pockets, the vehicle comprising:

a lifting frame including a lower frame part on which a lower carrier, provided with a pair of fork prongs, is mounted for movement vertically along said lifting frame as well as rotatably about an axis running horizontally and parallel to the fork prongs, above the lower carrier an upper frame part is provided, the upper frame part being moveable vertically along said lifting frame and provided with an upper carrier and a receiving arrangement on the upper carrier for taking hold of the cover of the container, the lifting frame being a two-part lifting frame including said lower frame part and said upper frame part, said frame parts defining a substantially vertical axis, the upper frame part being movably mounted on the lower frame part, for movement with respect to said lower frame part along said vertical axis, the receiving arrangement being vertically adjustable and/or swivelable up and down with respect to the lifting frame so as to remove the cover from the container, wherein the upper frame part is mounted on the lower frame part and carries the upper carrier provided with the receiving arrangement.

2. Unloading vehicle according to claim 1, characterized in that the receiving arrangement has a further pair of fork prongs.

3. Unloading vehicle according to claim 1, characterized in that the receiving arrangement has an electromagnet.

4. Unloading vehicle according to claim 1, characterized in that the upper carrier is arranged so as to be swivelable up and down on the upper frame part.

5. Combination of an unloading vehicle with a container comprising a container cover, comprising:

the unloading vehicle of claim 1;

a container; and a cover on the container; wherein the receiving arrangement on the upper carrier comprising a further pair of fork prongs for taking hold of the cover of the container, said upper carrier being vertically adjustable and/or swivelable up and down with respect to the frame, and the container cover comprises a pair of fork receiving locations for receiving said further pair of fork prongs.

6. Combination of an unloading vehicle with a container comprising a container cover, comprising:

the unloading vehicle of claim 1;

a container; and a cover on the container; wherein the receiving arrangement on the upper carrier comprising an electromagnet for taking hold of the cover of the container, said upper carrier being vertically adjustable and/or swivelable up and down with respect to the frame, and the container cover comprises a metallic part, arranged for being engaged by said electromagnet.

7. Unloading vehicle for the rotary unloading of a container, the container being configured to be covered by a cover, the container having a container base with two fork pockets, the vehicle comprising:

a two-part lifting frame including a lower frame part and an upper frame part, said frame parts defining a substantially vertical axis, the upper frame part being movably mounted on the lower frame part, for a movement with respect to said lower frame part along said vertical axis, a lower carrier, provided with a pair of fork prongs, being moveably mounted on the lower frame part for a movement vertically along said lower frame part as well as rotatably about an axis running horizontally and parallel to the fork prongs, and an upper carrier being mounted on the upper frame part, said upper carrier having a pair of fork prongs extending parallel to the fork prongs provided on the lower carrier.

8. Unloading vehicle according to claim 7, said upper carrier and its pair of fork prongs being vertically movable with respect to the lifting frame so as to remove the cover from the container.

9. Combination of an unloading vehicle with a container comprising a container cover, comprising:

the unloading vehicle of claim 7;

a container; and a cover on the container; wherein the container cover comprises a pair of fork receiving locations for receiving said pair of fork prongs on said upper carrier.

10. Unloading vehicle for the rotary unloading of a container, the container being configured to be covered by a cover, the container having a container base with two fork pockets, the vehicle comprising:

a two-part lifting frame including a lower frame part and an upper frame part, both said frame parts defining substantially vertical axis, the upper frame part being movably mounted on the lower frame part, for a movement with respect to said lower frame part along said vertical axis, a lower carrier, provided with a pair of fork prongs, being moveably mounted on the lower frame part for a movement vertically along said lower frame part as well as rotatably about an axis running horizontally and parallel to the fork prongs, and an upper carrier being mounted on the upper frame part, said upper carrier having a pair of fork prongs, said upper carrier being pivotally mounted on the upper frame part, for pivoting said fork prongs about a horizontal axis running transversely to the fork prongs, so as to remove the cover from the container.

11. Combination of an unloading vehicle with a container comprising a container cover, comprising:

the unloading vehicle of claim 10;

a container; and a cover on the container; wherein the container cover comprises a pair of fork receiving locations for receiving said pair of fork prongs on said upper carrier.

* * * * *